US005555709A

United States Patent [19]

Savigny et al.

[11] Patent Number: 5,555,709

[45] Date of Patent: Sep. 17, 1996

[54] CAROUSEL BAGGER MACHINE

[75] Inventors: Edward B. Savigny, Newfane; James G. Savigny, Youngstown, both of N.Y.

[73] Assignee: Ag-Pak, Inc., Gasport, N.Y.

[21] Appl. No.: 541,576

[22] Filed: Oct. 10, 1995

[51] Int. Cl.[6] ..... B65B 43/28

[52] U.S. Cl. ..... 53/570; 53/247; 53/253; 141/313; 141/145; 141/94

[58] Field of Search ..... 53/542, 570, 571, 53/247, 253, 249, 250, 284.7, 506, 202; 141/10, 114, 313, 314, 317, 144, 145, 94

[56] References Cited

U.S. PATENT DOCUMENTS

| | | | |
|---|---|---|---|
| 2,654,518 | 10/1953 | Kindseth | 226/55 |
| 2,763,109 | 9/1956 | Baker | 53/135 |
| 2,784,749 | 3/1957 | Baker | 141/314 |
| 2,830,687 | 4/1958 | Baker | 193/21 |
| 2,949,714 | 8/1960 | Davis | 53/506 |
| 3,097,459 | 7/1963 | Rausch | 53/59 |
| 3,215,173 | 11/1965 | Rutherford | 141/83 |
| 3,406,727 | 10/1968 | Rexus | 141/131 |
| 3,416,620 | 12/1968 | McClusky | 177/123 |
| 3,498,020 | 3/1970 | Eppenberger | 53/55 |
| 3,530,646 | 9/1970 | Amada et al. | 53/250 |
| 3,540,497 | 11/1970 | Troyer | 141/314 |
| 3,842,569 | 10/1974 | McClelland et al. | 53/37 |
| 4,389,834 | 6/1983 | Wysocki | 53/570 |
| 4,526,214 | 7/1985 | McGregor | 141/59 |
| 5,001,889 | 3/1991 | Mueller | 53/502 |
| 5,005,341 | 4/1991 | Tetenborg | 53/570 |
| 5,142,846 | 9/1992 | Alameda | 53/506 |
| 5,404,919 | 4/1995 | Felts et al. | 141/12 |

*Primary Examiner*—John Sipos
*Assistant Examiner*—John Paradiso
*Attorney, Agent, or Firm*—Joseph P. Gastel

[57] ABSTRACT

A carousel bagger having a frame, a table rotatably mounted on the frame, a plurality of conveyor troughs extending radially outwardly from the table, each of the conveyor troughs including a trough and a conveyor, bag-gripping structure mounted at the outer ends of the troughs, and chutes formed integrally with the bag-gripping structure such that when a bag is properly gripped, the chute will always be in a position to guide produce from the conveyor into a gripped bag. A chute-clogging detection structure located in relationship to the chutes for stopping the bagger in the event a clogged chute is detected. A bag-detection structure for preventing the deposit of produce from a hopper into a conveyor trough in the event that a bag is not being held by the bag-gripping structure associated with the trough.

17 Claims, 12 Drawing Sheets

Fig. 8D.
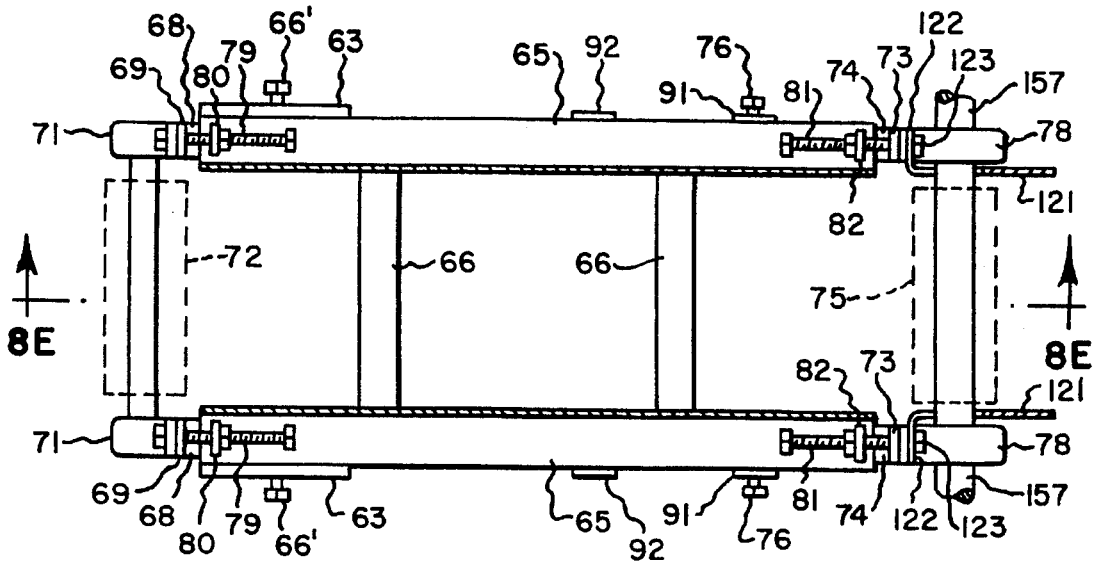
Fig. 8E.
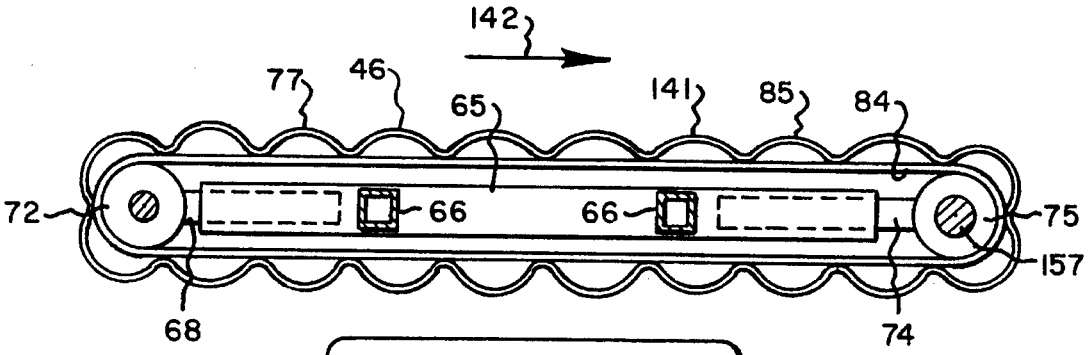
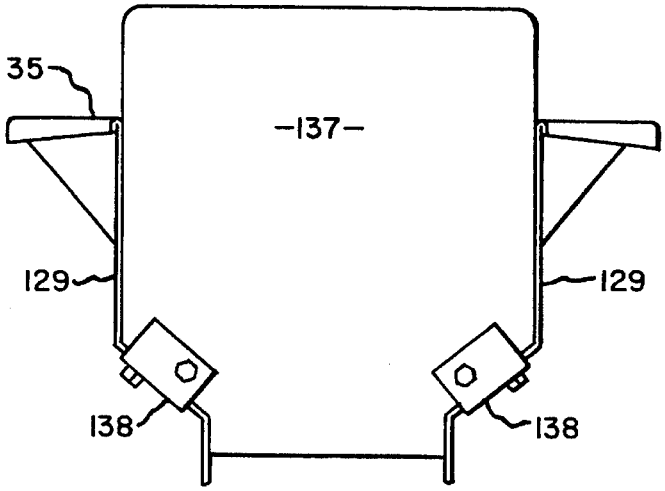
Fig. 8F.

Fig. 9.
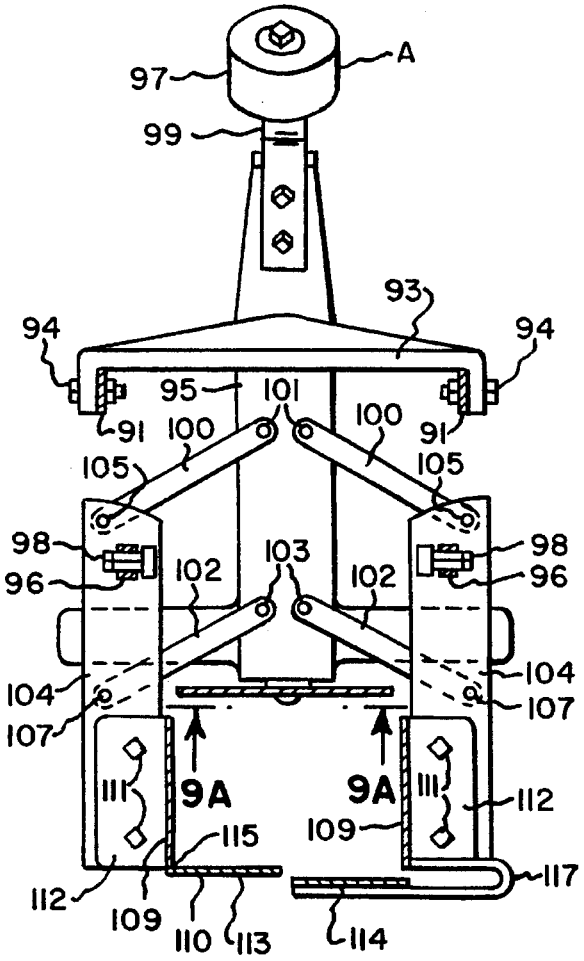
Fig. 12.
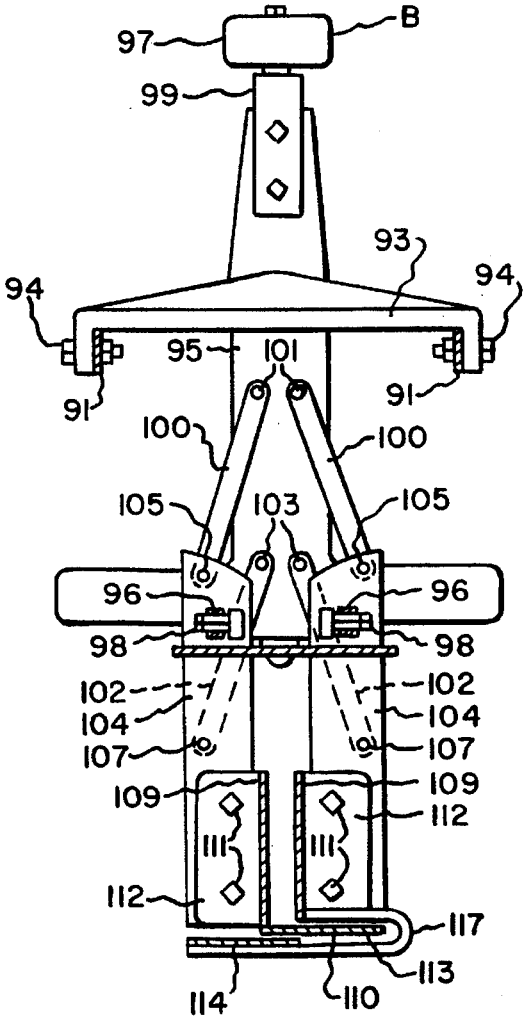
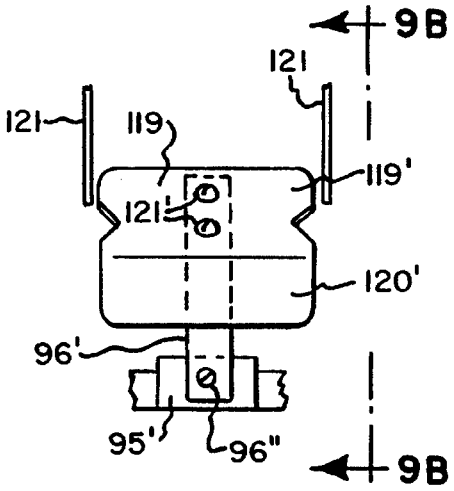
Fig. 9A.
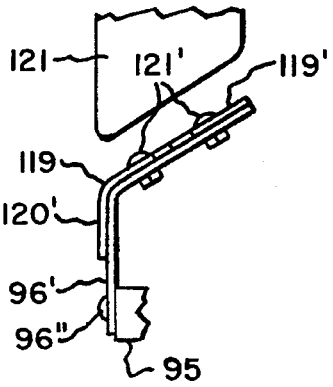
Fig. 9B.

Fig. 11.
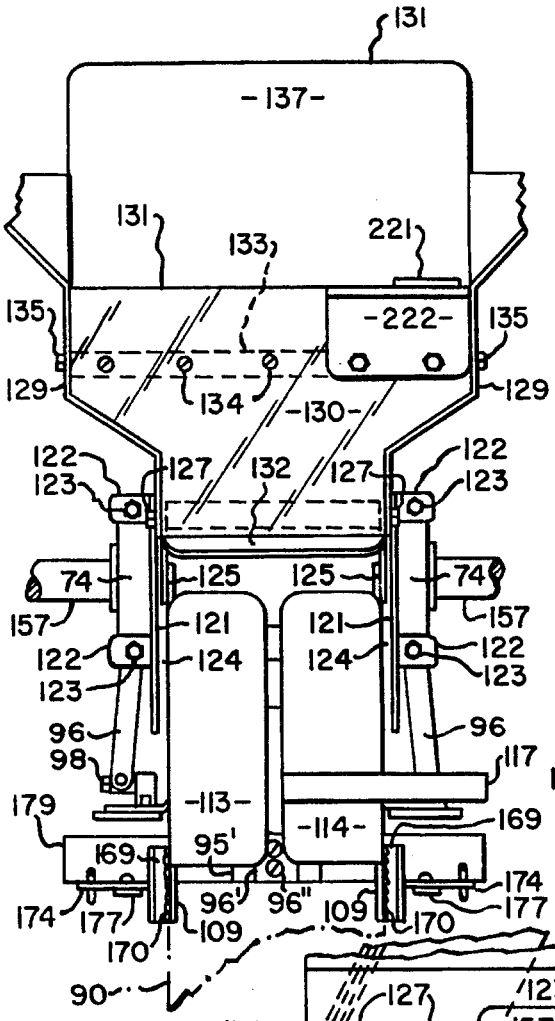
Fig. 14.
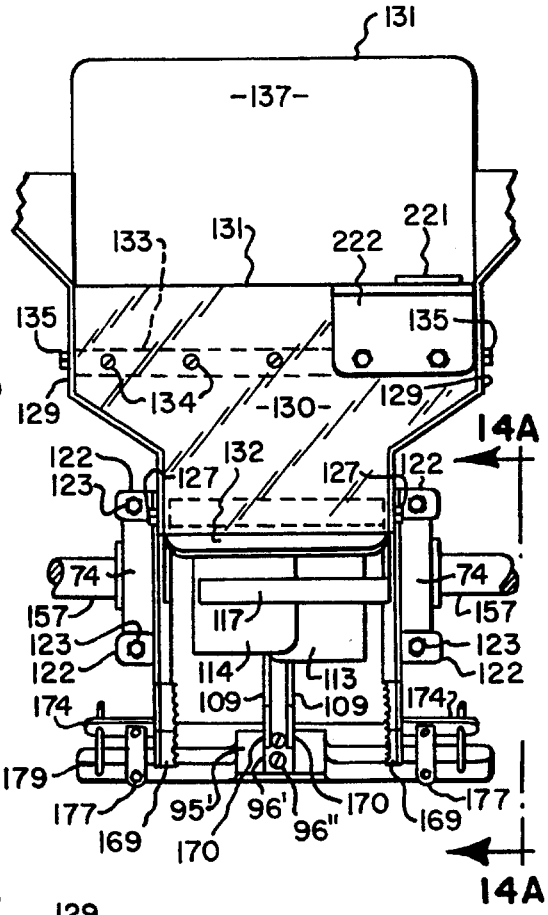
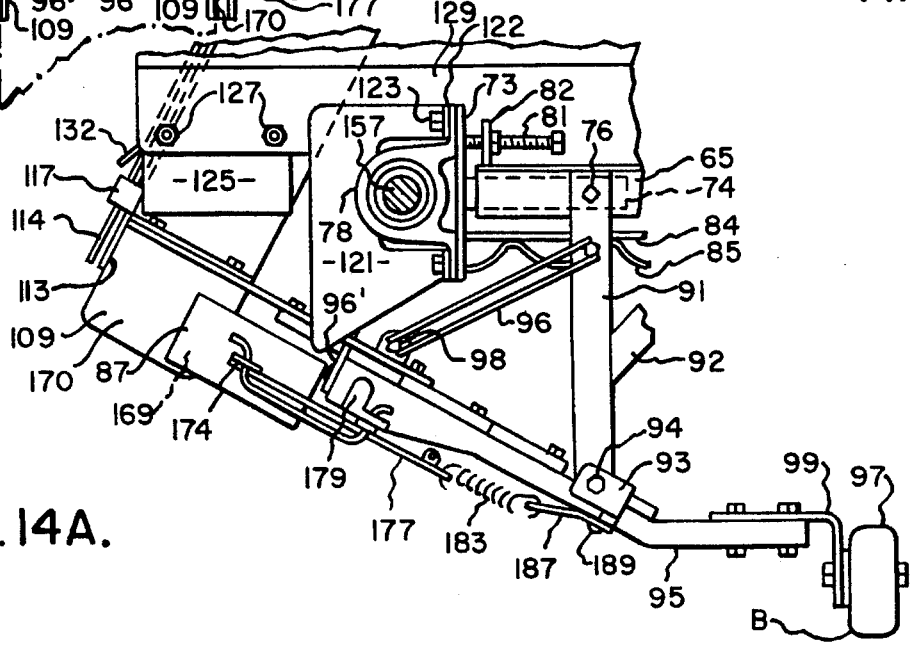
Fig. 14A.

CAROUSEL BAGGER MACHINE

BACKGROUND OF THE INVENTION

The present invention relates to an improved bagger and to an improved bagging system containing said bagger.

By way of background, carousel type of baggers for bagging produce are known. Additionally, certain of these baggers contain conveyor troughs for receiving produce and for conveying the produce to bags which are held by gripping structure. In addition, certain of these baggers contain chutes at the ends of the conveyors for guiding the produce into the gripped bags. However, the chutes have portions which move independently of the gripping mechanism so that if the chute is not functioning properly, the produce is not guided from the conveyor into a bag. It is with overcoming this particular deficiency that one aspect of the present invention is concerned.

In addition, insofar as known, in certain prior carousel type of baggers, a chute leading to a gripped bag can become clogged, and, insofar as known, there was no way of stopping the bagger to unclog the chute. It is with overcoming the foregoing deficiencies of the prior art carousel baggers that the present invention is concerned.

SUMMARY OF THE INVENTION

It is one object of the present invention to provide an improved carousel bagger having conveyor troughs which include bag-gripping structure which is an integral part of a chute leading to the bag-gripping structure so that the chute is always positively located relative to a gripped bag for guiding the produce into the bag.

Another object of the present invention is to provide an improved carousel bagger which includes means for detecting a clogged chute and for shutting the bagger down to permit unclogging thereof. Other objects and attendant advantages of the present invention will readily be perceived hereafter.

The present invention relates to a carousel bagger comprising a frame, a vertical shaft rotatably mounted in said frame, a table affixed to said shaft above said frame, a plurality of conveyor troughs having inner and outer ends with said inner ends mounted on said table and said conveyor troughs extending radially outwardly therefrom, each of said conveyor troughs including a trough having an inner trough end and an outer trough end and including a conveyor having an inner conveyor end proximate said inner trough end and an outer conveyor end proximate said outer trough end, a first motor mounted on said frame, a first flexible drive coupled between said first motor and said vertical shaft for rotating said table, a first roller on said conveyor located proximate said inner conveyor end and a second roller located proximate said outer conveyor end and a conveyor belt encircling said first and second rollers, links connecting said second rollers of adjacent conveyors, a second motor mounted on said table, a second flexible drive coupled between said second motor and one of said links for driving said one of said links and all of said second rollers connected thereto, chutes mounted on said outer ends of said troughs, connected front plates and side plates forming the front wall and side walls of said chute, and bag-gripping means formed integrally with said side plates and located proximate said lower portions of said chutes.

The present invention also relates to a conveyor trough for a bagger comprising a trough having a trough inner end and a trough outer end and a lower portion extending between said trough inner end and said trough outer end, a conveyor mounted proximate said lower portion and having a conveyor inner end proximate said trough inner end and a conveyor outer end proximate said trough outer end, a chute mounted on said trough outer end, first and second side plates on said chute, first and second front plates on said chute formed integrally with said first and second side plates, respectively, lower portions on said first and second side plates, first and second bag-gripping means forming integral portions of said lower portions of said first and second side plates, respectively, first and second side pads mounted on said trough and located outwardly of said first and second bag-gripping means, and linkage means for moving said first and second side plates and said first and second front plates toward each other as a unit and away from said first and second pads, respectively, for mounting a bag on said lower portions of said first and second side plates, and for moving said first and second side plates away from each other to clamp a bag between said first and second bag-gripping means and said first and second pads, respectively, whereby said first and second side plates and said first and second front plates positively form said chute when said bag is secured between said first and second side plates and said first and second pads, respectively.

The present invention also relates to a carousel bagger comprising a frame, a table rotatably mounted on said frame, a plurality of conveyor troughs mounted on said table, each of said conveyor troughs including a trough and a conveyor, bag-gripping mechanism mounted on each of said troughs, chutes mounted on each of said troughs between said conveyors and said bag-gripping mechanism, and chute-clogging detection means mounted relative to said chutes for detecting clogging of said chutes.

The various aspects of the present invention will be more fully understood when the following portions of the specification are read in conjunction with the accompanying drawings wherein:

BRIEF DESCRIPTION OF THE DRAWINGS

FIG. 8D is a fragmentary cross sectional view taken substantially along line 8D—8D of FIG. 8;

FIG. 8E is a cross sectional view taken substantially along line 8E—8E of FIG. 8D;

FIG. 8F is a view taken substantially in the direction of arrows 8F—8F of FIG. 8;

FIG. 9 is a fragmentary cross sectional view taken substantially along line 9—9 of FIG. 8 and showing the linkage which opens and closes the bag-gripping structure when the linkage causes the structure to be in a bag-gripping position;

FIG. 9A is a fragmentary view taken substantially in the direction of arrows 9A—9A of FIG. 9;

FIG. 9B is a fragmentary view taken substantially in the direction of arrows 9B—9B of FIG. 9A;

FIG. 11 is a fragmentary view taken substantially in the direction of arrows 11—11 of FIG. 8 and showing the gripping structure in a bag-gripping position and also showing the positions of the various portions of the chute at the end of the conveyor trough when the bag is being gripped;

FIG. 12 is a view analogous to FIG. 9 but showing the positions of the various links and the portions of the chute when the bag-gripping structure are moved to an open position;

FIG. 14 is a view analogous to FIG. 11 but showing the positions of the various parts of the chute at the end of the conveyor of the conveyor trough when the bag-gripping structure is in an open position;

FIG. 14A is a view taken substantially in the direction of arrows 14A—14A of FIG. 14;

DESCRIPTION OF THE PREFERRED EMBODIMENTS

Figure 1:
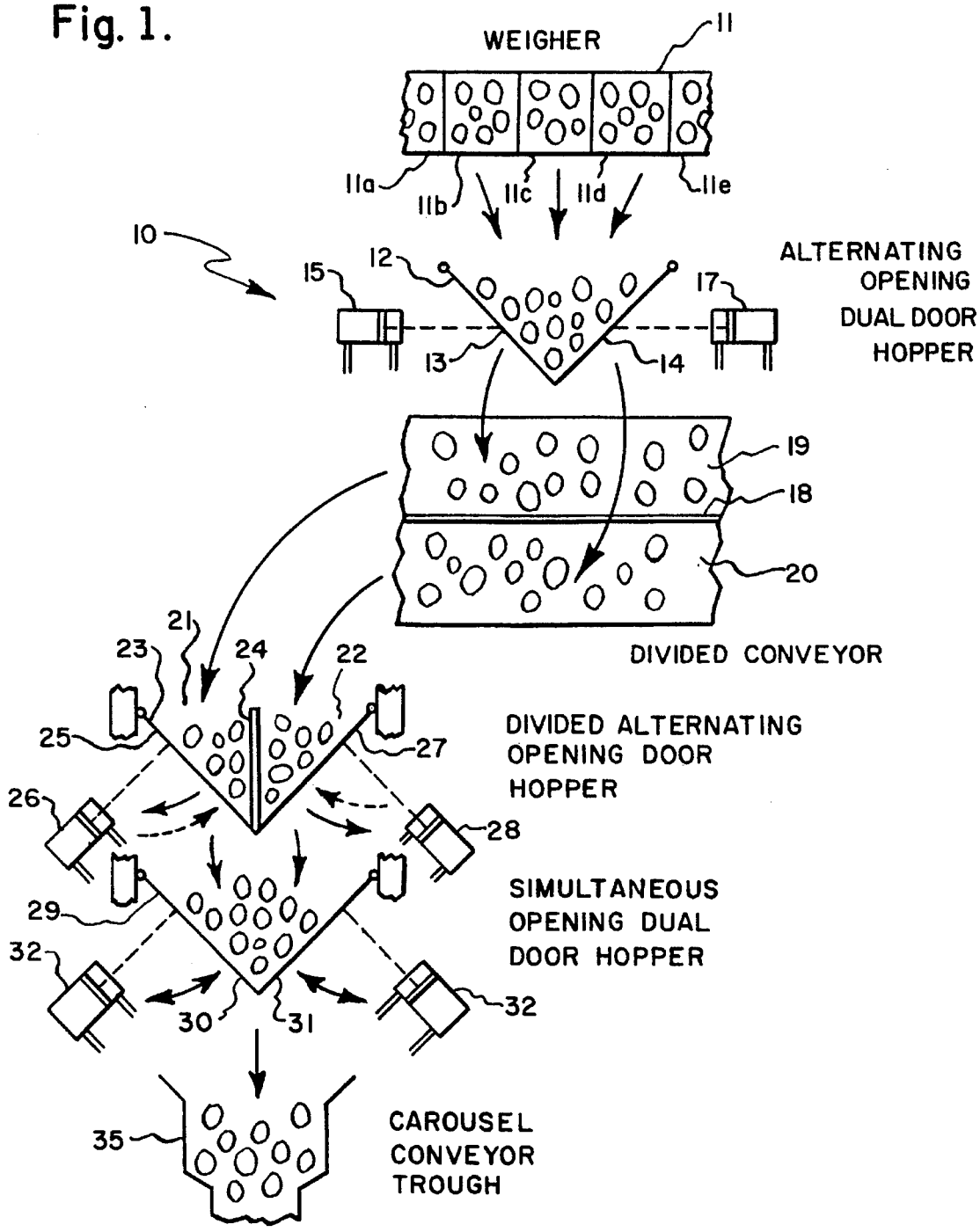
FIG. 1 is a schematic view of a produce bagging system showing the various stations of handling produce between a weigher and the improved carousel bagger of the present invention.

The improved system 10 (FIG. 1) includes a conventional multi-bay weigher 11 which is well known in the art, and it periodically opens a computer-selected number of its bays 11*a*, 11*b*, 11*c*, 11*d*, 11*e*, etc. to provide a predetermined weight of produce such as potatoes to an alternating opening dual door hopper 12 which has doors 13 and 14 which are alternately opened by suitable pneumatic motors or cylinders 15 and 17, respectively, to deposit produce onto conveyors 19 and 20, respectively, which are divided by a partition 18 which in turn deposit the produce into sections 21 and 22, respectively, of hopper 23 having a divider 24 therebetween. Hopper 23 has doors 25 and 27 coupled to pneumatic motors or cylinders 26 and 28, respectively, which alternately open sections 21 and 22, respectively, each of which alternately deposits produce into hopper 29 which has doors 30 and 31 which are opened simultaneously by pneumatic motors or cylinders 32 to deposit the produce into a conveyor trough 35 of carousel bagger 37 as it reaches the proper position under hopper 29. The foregoing system between weigher 11 and hopper 29 is known in the prior art but is being broadly described inasmuch as it is related to the carousel bagger 37 of the present invention.

Figure 2:
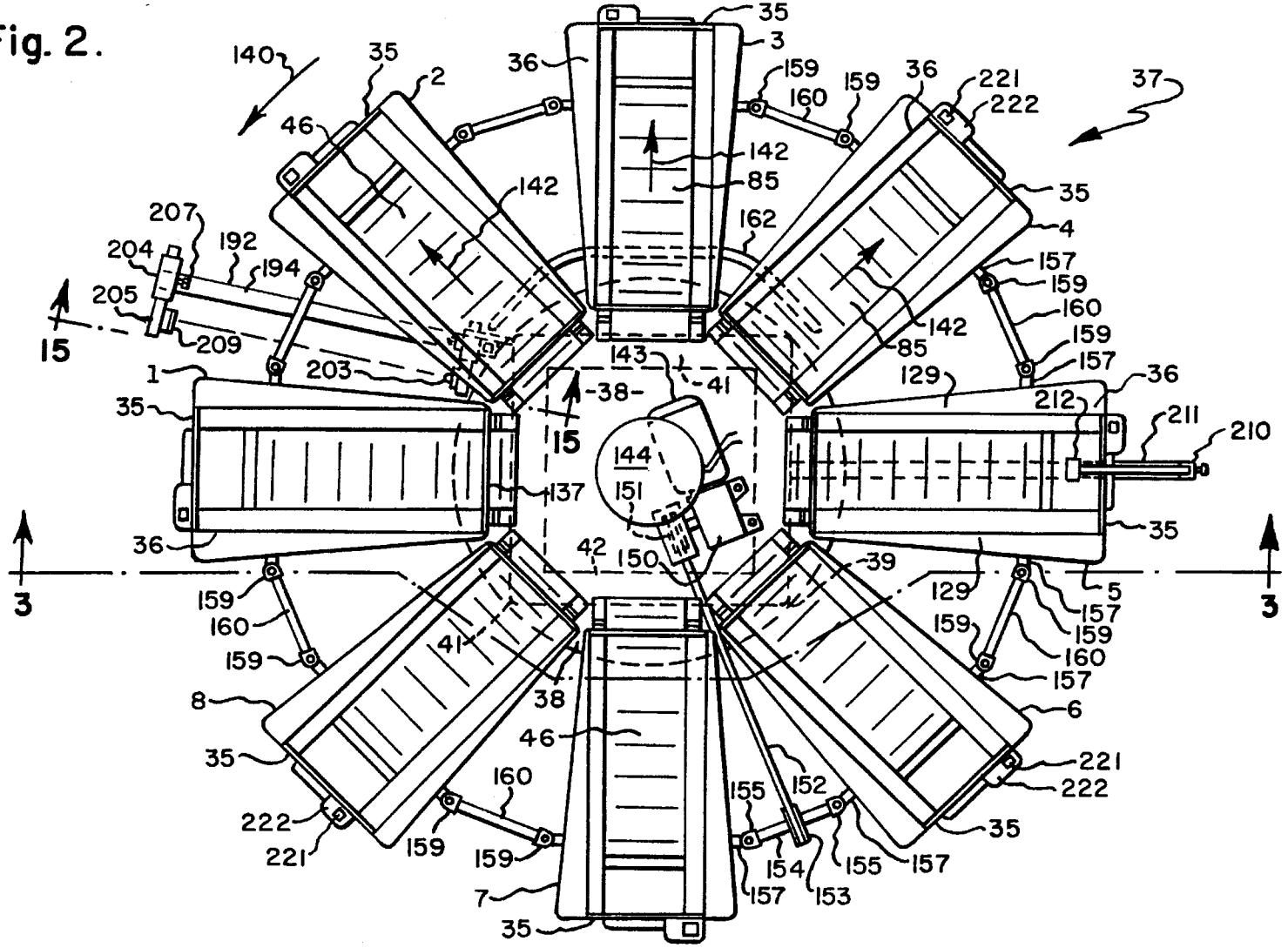
FIG. 2 is a plan view of the improved carousel bagger of the present invention taken substantially in the direction of arrows 2—2 of FIG. 3.
Figure 3:
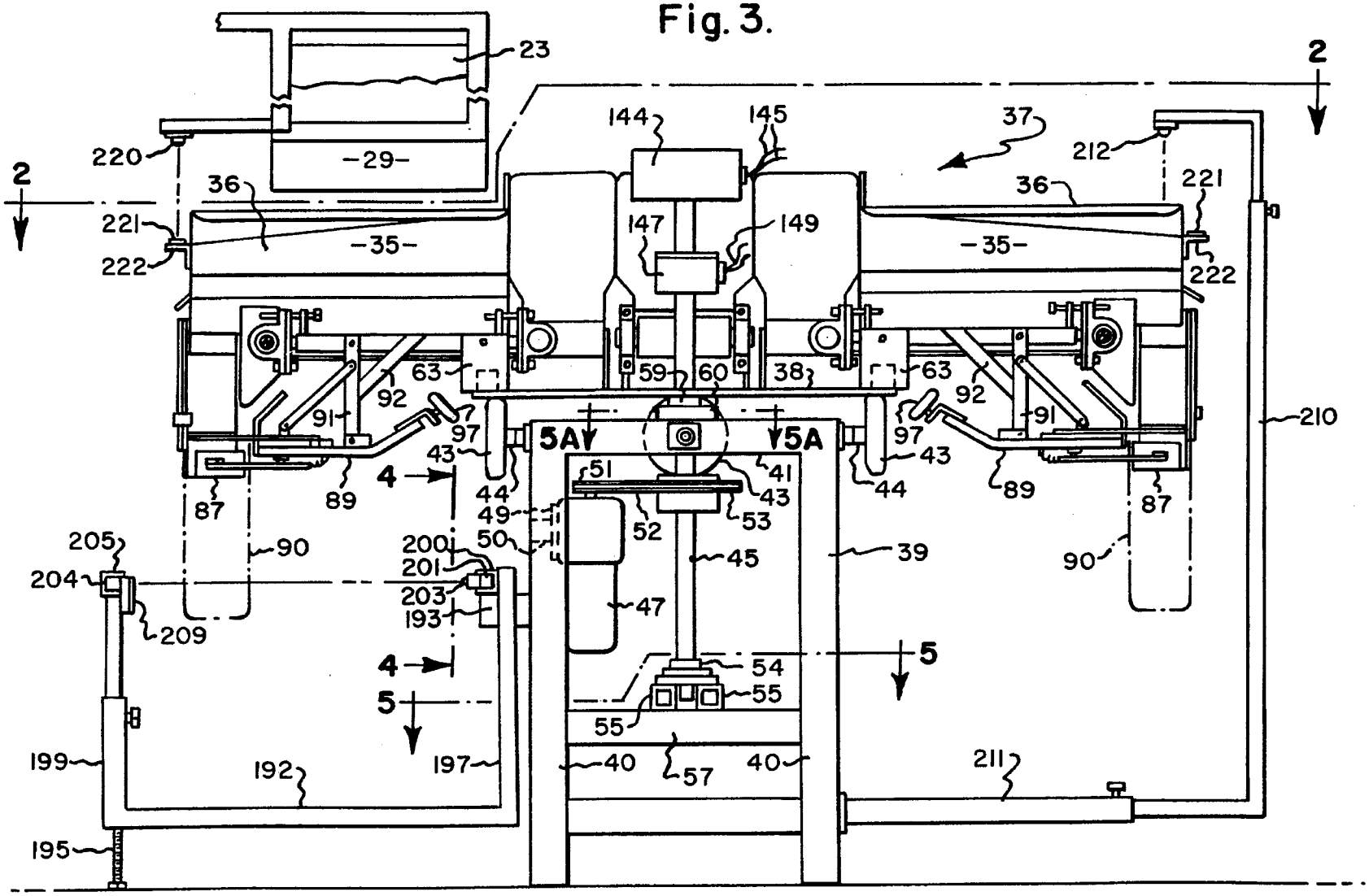
FIG. 3 is a view taken substantially in the direction of arrows 3—3 of FIG. 2 with certain parts of the carousel bagger omitted and fragmentarily showing the stacked hoppers which feed produce to the conveyor trough of the carousel bagger.
Figure 5:
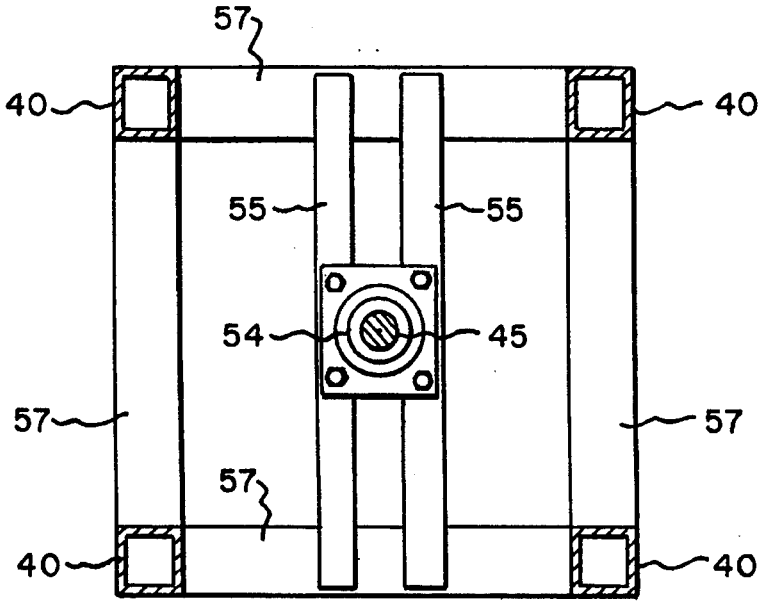
FIG. 5 is a fragmentary cross sectional view taken substantially along line 5—5 of FIG. 3 and showing the lower mounting for the main drive shaft.
Figure 5A:
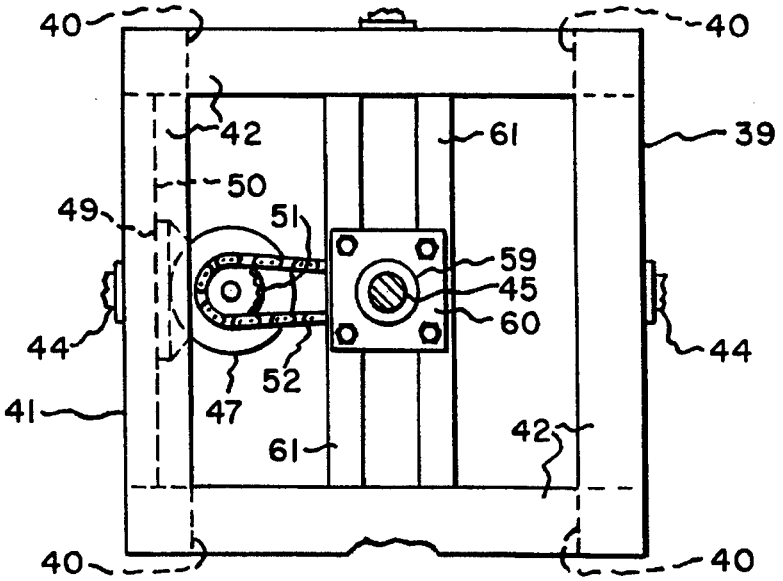
FIG. 5A is a cross sectional view taken substantially along line 5A—5A of FIG. 3 and showing the upper mounting for the main drive shaft.
Figure 8:
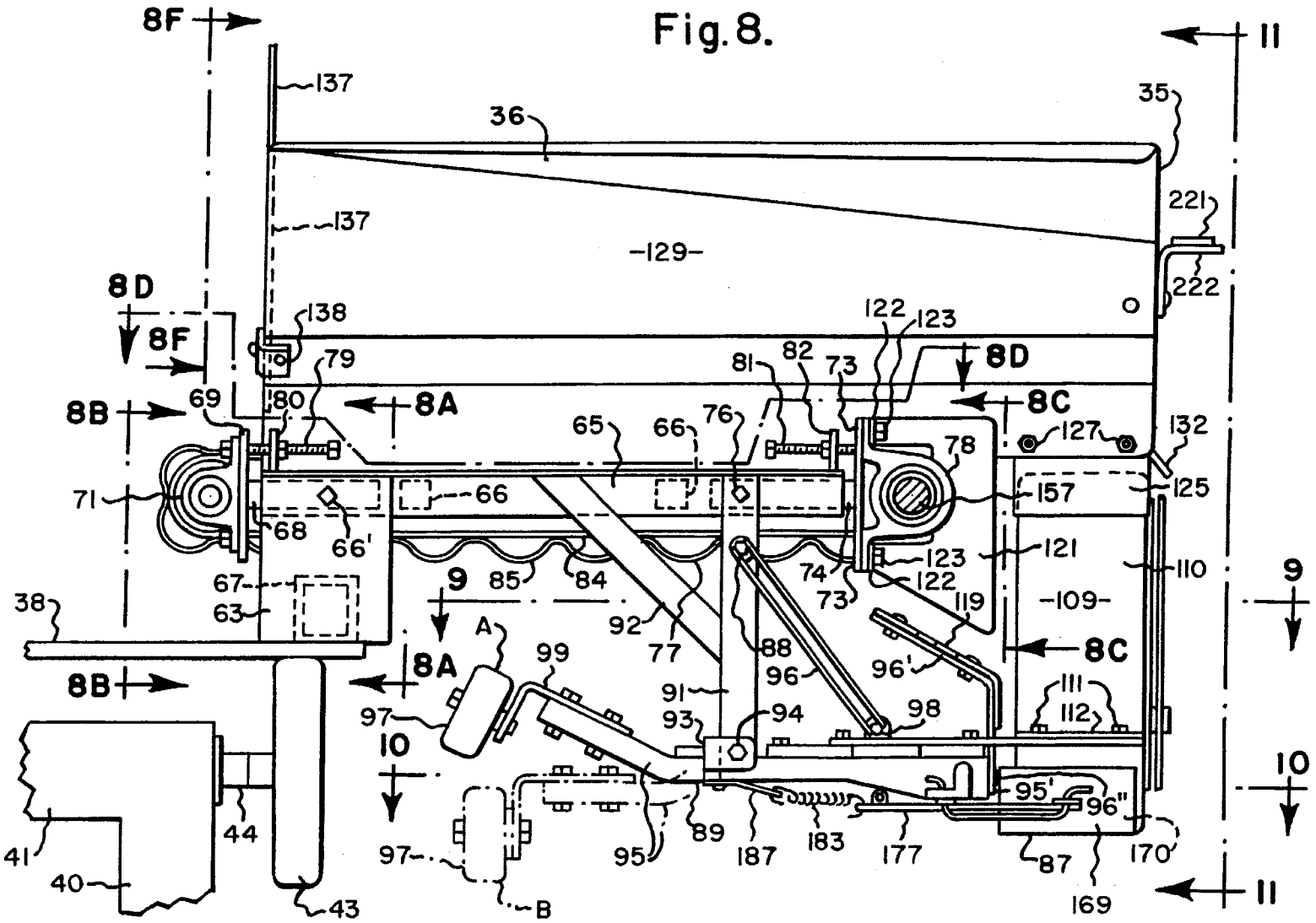
FIG. 8 is an enlarged fragmentary side elevational view of one of the conveyor troughs of the carousel bagger.

The carousel bagger 37 (FIG. 2) includes eight conveyor troughs 35 mounted on a rotating table 38 (FIGS. 2, 3 and 8). More specifically, the carousel bagger 37 includes a frame 39 having four legs 40 which mount a horizontal square frame portion 41 (FIG. 5A) at their upper ends. The square frame portion 41 has four sides 42 (FIG. 5A). A roller 43 (FIG. 3) is mounted on a horizontal shaft 44 which extends outwardly from each of the four sides 42 of frame 41. Each roller 43 is suitably mounted on bearings on shaft 44 for free rotatable movement. A rotatable table 38 is supported on the four rollers 43.

Figure 4:
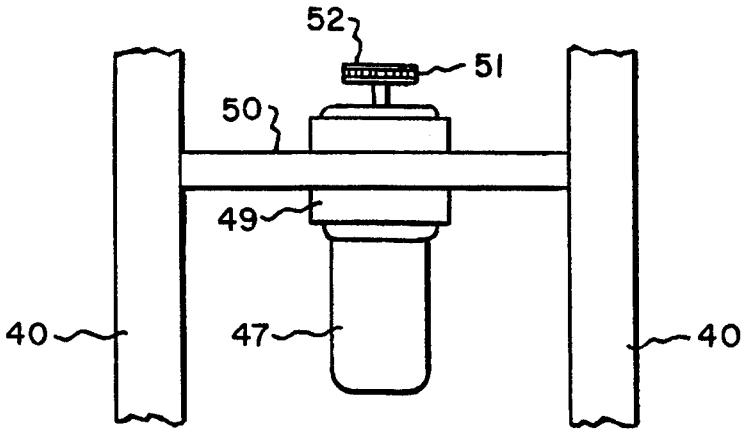
FIG. 4 is a fragmentary side elevational view taken substantially in the direction of arrows 4—4 of FIG. 3 and showing the drive motor mounted on the frame.

Rotatable table 39 is keyed to shaft 45 about the axis of which it rotates. More specifically, a drive motor 47 (FIGS. 3 and 4) is mounted on bracket 49 which is suitably secured to strut 50 which in turn has its opposite ends secured as by welding to a pair of adjacent legs 40 of the frame 39. Motor 47 drives a sprocket 51 (FIGS. 3 and 4) which in turn drives a flexible drive in the form of a chain 52 which encircles a sprocket 53 (FIG. 3) keyed to shaft 45. It will be appreciated that a flexible drive such as a belt may also be used. The lower end of shaft 45 (FIG. 5) is mounted in a bearing 54 suitably mounted on cross struts 55 which extend across and are secured to a pair of opposed leg braces 57 which extend between and have their ends secured to an adjacent pair of frame legs 40. An upper portion of shaft 45 (FIG. 5A) is journaled in bearing 59 mounted on bracket 60 suitably secured to struts 61 which have their opposite ends suitably secured as by welding between opposite sides 42 of frame 41.

Figure 8A:
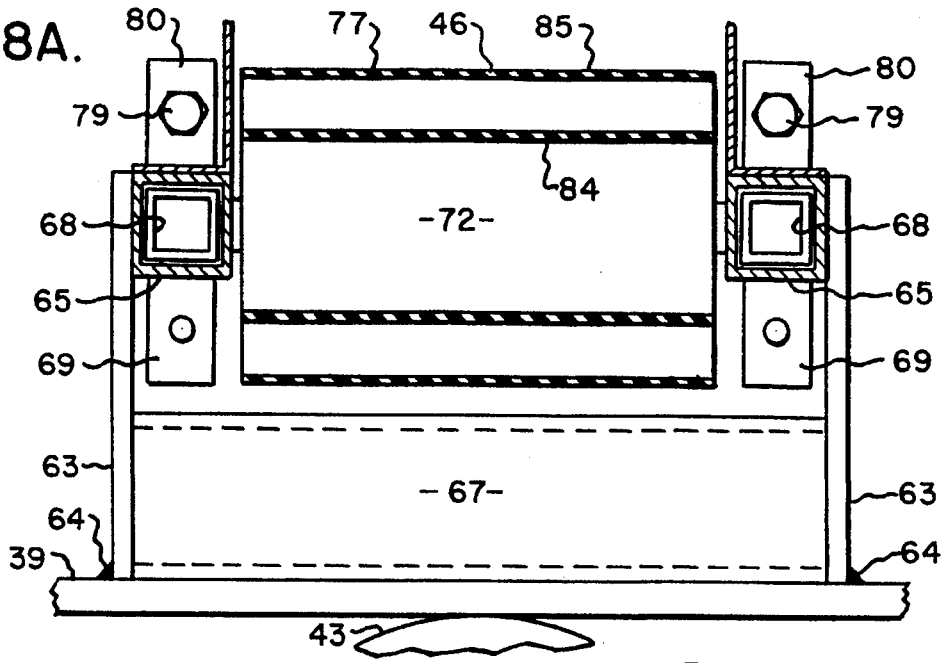
FIG. 8A is a fragmentary cross sectional view taken substantially along line 8A—8A of FIG. 8.
Figure 8B:
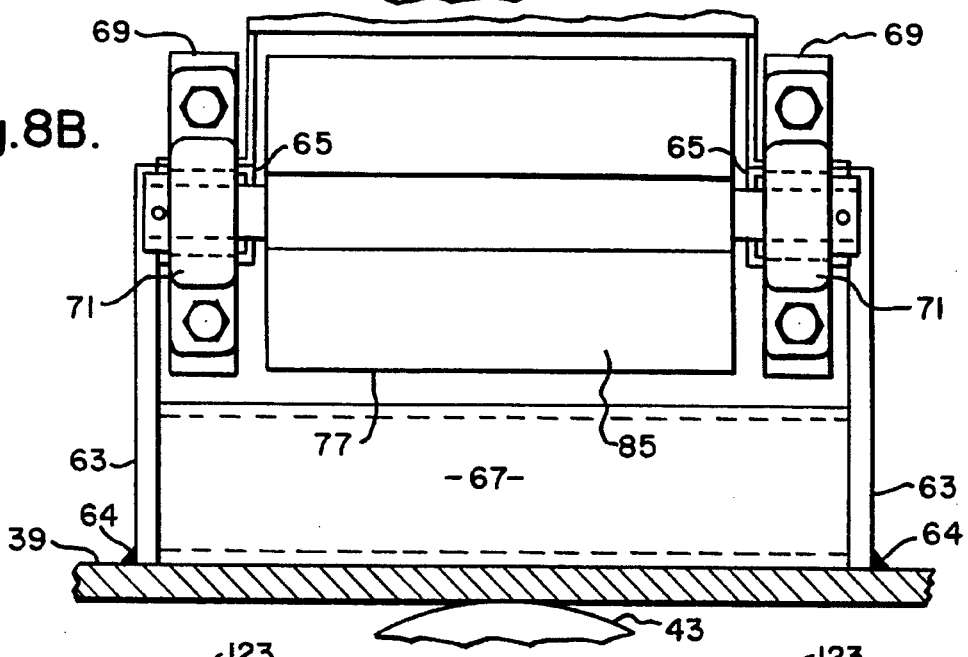
FIG. 8B is a fragmentary cross sectional view taken substantially along line 8B—8B of FIG. 8.

As noted above, the carousel bagger 37 has a plurality of conveyor troughs 35 mounted on rotating table 38. Each conveyor trough 35 includes a trough 36 and a conveyor 46. The trough 36 is mounted on the outer edge of table 38 (FIGS. 8 and 8A) by a spaced pair of metal plates 63 welded to table 39 at 64 and extending upwardly therefrom. A pair of tubular members 65 (FIGS. 8A and 8D) are welded to the upper portions of plates 63 and extend outwardly therefrom in cantilever fashion. Struts 66 (FIG. 8D) have their opposite ends welded to the facing sides of tubular members 65 to stabilize them. A tubular brace 67 (FIG. 8A) has its opposite ends welded between the lower portions of plates 63 to further reinforce them. Plates 69 are welded to the ends of tubular members 68 (FIGS. 8, 8A and 8B) which are telescopically received within tubular members 65 and held therein by set screws 66'.

Figure 8C:
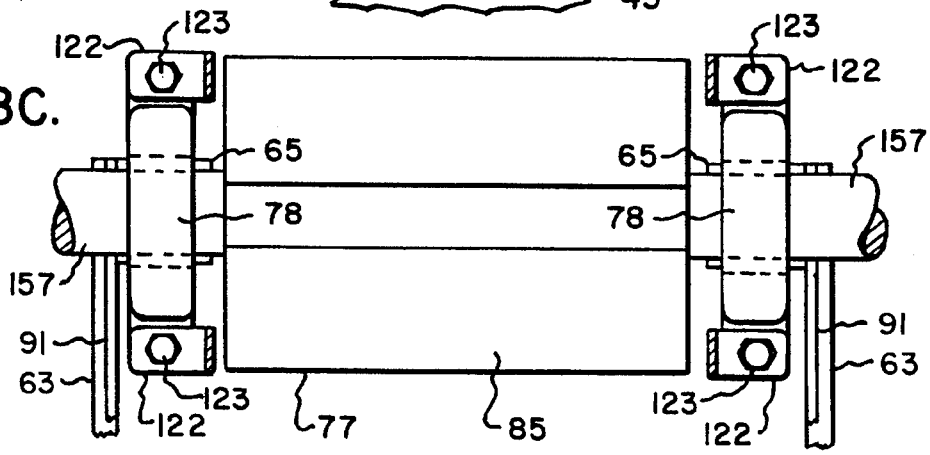
FIG. 8C is a fragmentary cross sectional view taken substantially along line 8C—8C of FIG. 8.
Figure 15:
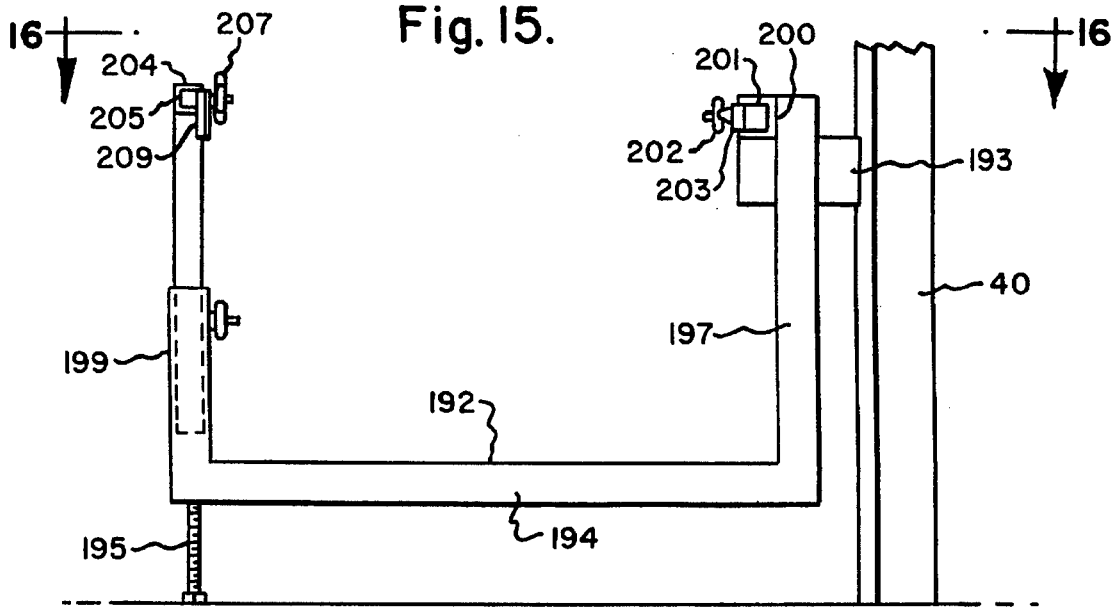
FIG. 15 is a fragmentary side elevational view taken substantially in the direction of arrows 15—15 of FIG. 2 and showing in side elevation the bag-detecting structure for preventing dumping from the conveyor trough if a bag is not mounted at the end of the chute.
Figure 16:
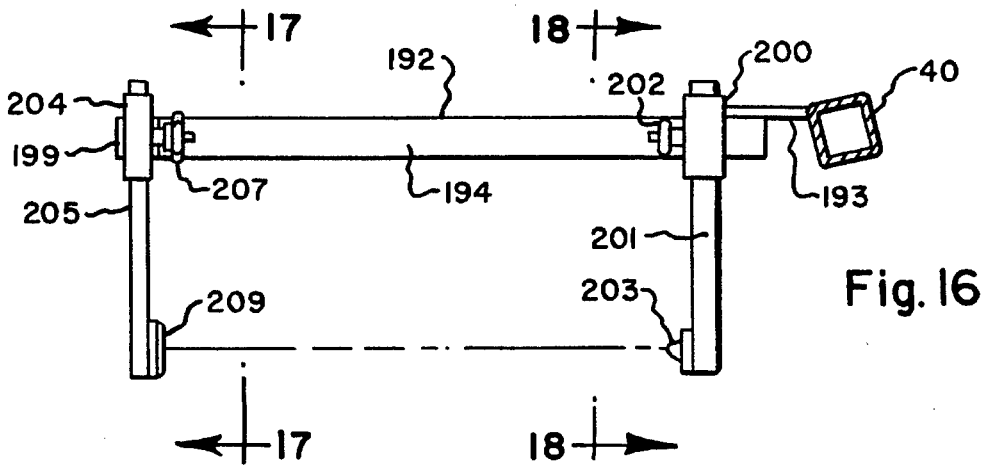
FIG. 16 is a cross sectional view taken substantially along line 16—16 of FIG. 15.
Figure 17:
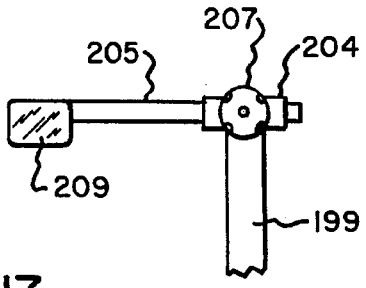
FIG. 17 is a fragmentary elevational view taken substantially in the direction of arrows 17—17 of FIG. 16.
Figure 18:
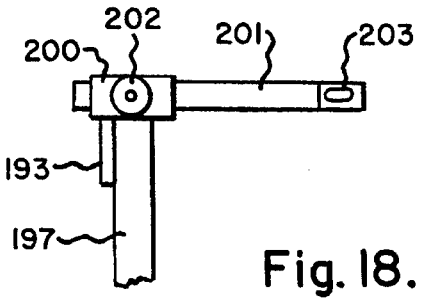
FIG. 18 is a fragmentary elevational view taken substantially in the direction of arrows 18—18 of FIG. 16.

The conveyor 46 of conveyor trough 35 includes bearings 71 (FIGS. 8 and 8B) which are mounted on plates 69 and journal the ends of roller 72 (FIG. 8D). Plates 73 (FIGS. 8 and 8D) are mounted at the ends of tubular members 74 which telescope within tubular members 65, and plates 73 carry bearings 78 (FIGS. 8 and 8C) which support roller 75 (FIG. 8E). Tubular members 74 are held in position by set screws 76 (FIG. 8). Tubular members 68 and 74 can be moved to adjusted positions, and thereafter set screws 66' and 76, respectively, are tightened so that the conveyor belt 77 (FIG. 8E) which extends around rollers 72 and 75 can be tightened to the proper tension. A stabilizing screw 79 (FIG. 8) is associated with each plate 69 and extends through a tab 80 mounted on tubular member 65 and the end of the screw bears against the upper end of plate 69. Additionally, a stabilizing screw 81 (FIG. 8) is associated with each plate 73 and extends through a tab 82 welded to tubular member 65. The ends of screws 81 bear against plates 73 to further stabilize the roller carried by them. The conveyor belt 77 which encircles rollers 72 and 75 includes a planar base portion 84 (FIG. 8E) and a resilient sinusoidal layer 85 onto which the produce is deposited. The resilient layer cushions the fall of the produce, and the produce comes to rest between the sinusoidal undulations. Belts of this type are in common usage in the prior art.

An integrated bag-gripping and chute mechanism 87 (FIGS. 8–14) and associated linkage 89 are mounted on the trough 46 of each conveyor trough 35 for cyclically gripping and releasing bags 90 into which the produce is guided and deposited from each conveyor trough 35. Because the bag-gripping mechanism and chute 110 operate as an integral unit, when a bag is gripped, the chute inherently has to be in position to guide the produce into the gripped bag, as expressed in greater detail hereafter. More specifically, struts 91 and 92 (FIGS. 8 and 8D) have their upper ends welded to the outsides of tubular members 65. A cross bar 93 (FIGS. 8 and 9) is pivotally mounted on pins 94 at the lower ends of struts 91. An elongated central member 95 is formed integrally with cross bar 93 (FIGS. 8 and 9). A roller 97 is rotatably mounted on bracket 99 mounted on the outer end of member 95. A first pair of links 100 have their inner ends pivotally mounted on member 95 at 101. A second pair of links 102 have their inner ends mounted on member 95 at 103. The outer ends of links 100 and 102 are pivotally mounted on elongated members 104 at 105 and 107, respectively. Links 96 (FIGS. 8 and 9) have their lower ends pivotally mounted to members 104 at 98 and their upper ends pivotally secured to strut 91 (FIG. 8) at 88.

A chute 110 is mounted at the outer end of each of the conveyor troughs 35. Side plates 109 of chute 110 are mounted on members 104 by screws 111 which pass through the flanges 112 at the lower ends of side plates 109. Chute front plates 113 and 114 are secured to chute side plates 109. In this respect, chute front plate 113 extends at right angles to and is welded to side plate 109 at 115. Chute front plate 114 is secured to chute side plate 109 by bracket 117. The chute faces 113 and 114 are frontally offset from each other in all positions thereof (FIGS. 9 and 12). A chute rear wall 119 (FIGS. 8, 9, 9A and 9B) is secured to the end 95' of member 95. In this respect, a bracket 96' (FIG. 9A) has its lower end secured to end 95' by a screw 96". Chute rear wall 119 has an upper inclined portion 119' and a lower vertical portion 120'. The upper portion of bracket 96' lies flush against the rear of rear wall 119, and rear wall 119 is secured to bracket 96' by bolts 121' (FIGS. 9A and 9B).

Plates 121 (FIGS. 8, 11 and 14A) form a part of each chute 110 and have flanges 122' thereon through which screws 123 extend to secure plates 121 to plates 73. The lower edges of plates 121 are spaced from side plates 109 by spaces 124 (FIG. 11). Upper side portions 125 (FIGS. 8 and 14A) are secured by bolts 127 to the lower portions of side walls 129 of the conveyor trough 35. A transparent plastic front plate 130 (FIGS. 11 and 14) has an upper edge 131 and a lower flared edge 132, and it fits in complementary mating relationship with the side walls 129 of the conveyor trough 35 above chute front plates 113 and 114. Plate 130 is mounted on a bar 133 by means of a plurality of screws 134, the bar itself being secured to sides 129 by screws 135. A rear wall 137 (FIGS. 8, 8F and 11) is suitably secured between trough side walls 129 by brackets 138. Thus, the trough consists of a pair of mirror image side walls 129 by brackets 138, a rear wall 137, and a front wall 130, and the chute 110 at the outer end of conveyor trough 35 consists of front plates 113 and 114, side plates 109, rear wall or plate 119, plates 121, and plates 125.

Figure 6:
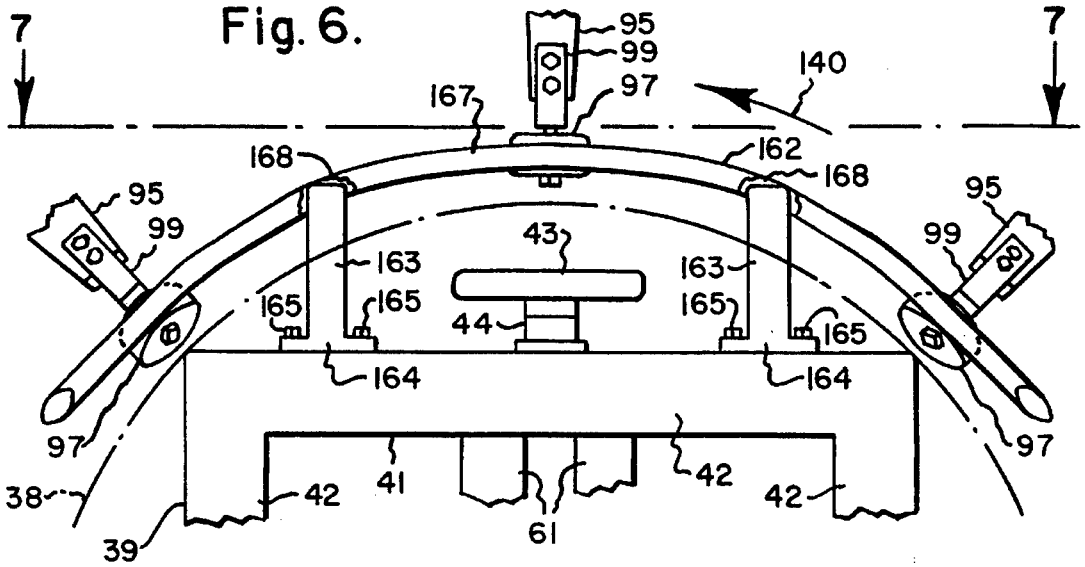
FIG. 6 is a fragmentary enlarged plan view of a portion of FIG. 2 and showing the cam bar mounted on the frame of the carousel bagger.
Figure 7:
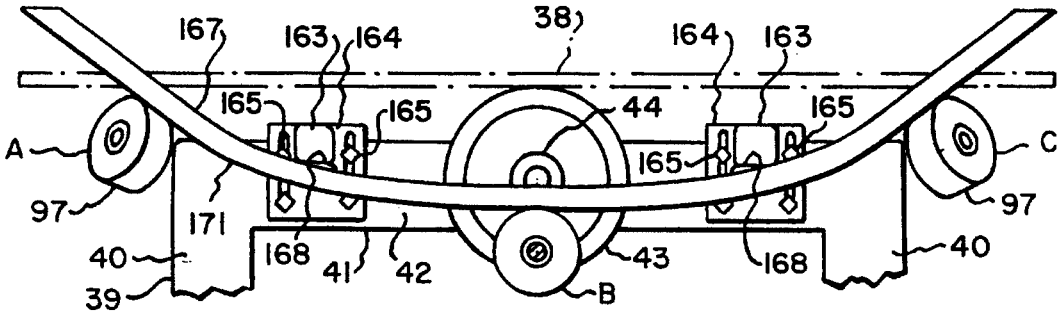
FIG. 7 is a fragmentary side elevational view taken substantially in the direction of arrows 7—7 of FIG. 6.
Figure 10:
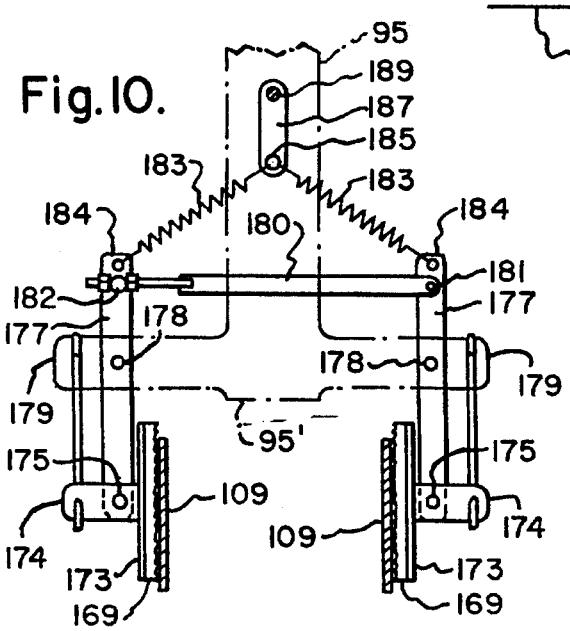
FIG. 10 is a fragmentary cross sectional view taken along line 10—10 of FIG. 8 and showing the bag-gripping structure in a bag-gripping position.

The carousel 37 is driven in the direction of arrow 140 (FIGS. 2, 6 and 7) by rotating table 39 by means of motor 47, as described above. Additionally, the upper runs 141 of conveyor belts 77 are driven in the direction of arrows 142 (FIGS. 2 and 8E) by means of motor 143 (FIG. 2) which is mounted on rotating table 39. The electric power to motor 143 is obtained through a conventional slip connection 144 (FIGS. 2 and 3) which conveys electric current from lead 145 to junction box 147 to which motor 143 is electrically connected by lead 149. Electric motor 143 is coupled to gear box 150 (FIG. 2) which drives sprocket 151 around which a flexible drive in the form of a chain 152 extends which in turn drives sprocket 153 which is keyed to drive shaft 154. It will be appreciated that the flexible drive may be in the form of a belt. Universals 155 are mounted at the ends of drive shaft 154 and are coupled to shafts 157 on the opposite sides of shaft 154. The other shafts 157 of each conveyor are coupled by means of universals 159 (FIG. 2) to rods 160 which extend between shafts 157 on which rollers 75 which drive conveyor belts 77 are mounted. Motor 143 drives all of the conveyors 46 by means of the chain 152, rod 154, universals 155, universals 159 and rods 160. Thus, motor 47 drives table 39 in direction 140 and motor 143 simultaneously drives conveyors 77 in the direction of arrows 142.

In accordance with the present invention, structure is provided for permitting an operator to mount a bag at the lower ends of chute 110 for subsequent filling of produce and permit another operator to remove the bag from chute 110 after it has been filled. In this respect, a cam bar 162 (FIGS. 2, 6 and 7) is secured to frame 41 by means of a pair of brackets 163 which are secured to a side 42 of frame 41 by a plurality of bolts 165, and the upper side 167 of cam bar 162 is welded at 169 to the outer ends of brackets 163.

Figure 13:
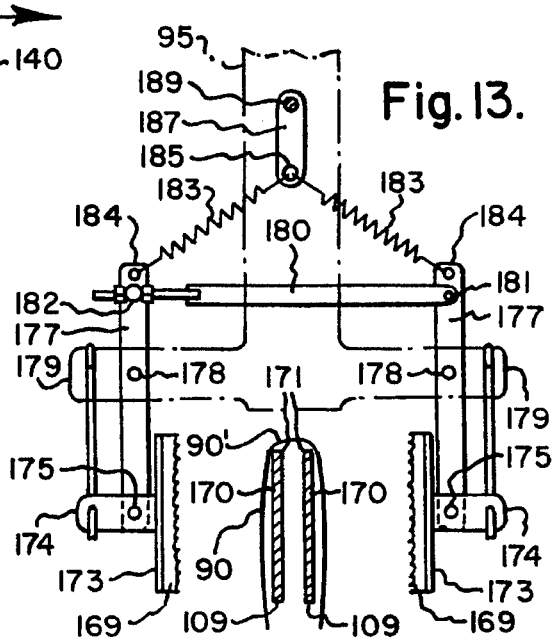
FIG. 13 is a view analogous to FIG. 10 but showing the bag-gripping structure in an open position for receiving a bag.

When roller 97 at the end of bar 95 is not in engagement with cam bar 162, the weight of the linkage 89 (FIG. 2) will cause the bag-gripping structure to occupy the positions shown in FIGS. 8, 9, 10 and 11. The linkage 89 consists of bar 95, the various links mounted thereon, and the plates 109, 113, 114 and 119 of chute 110. At this time a bag 90 will be gripped between gripper pads 169 (FIGS. 10 and 11) and the lower outer side portions 170 (FIGS. 8, 13 and 14A) of chute sides 109. As the table 39 rotates, a point will be reached where a roller 97 engages the underside 171 of cam bar 162 (FIG. 7) at approximately position A, and as it passes along cam bar 162 in the direction of arrow 140 to position B, it will move from its solid line position at A in FIG. 8 to its dotted line position at B. When it is in position B, the various links mounted on bar 95 will have been moved to the positions of FIG. 12, and in so doing, links 104 will move to the position of FIG. 12 thereby placing chute plates or sides 109 in the position of FIG. 12 from their previous positions of FIG. 9. In the position of FIG. 12, chute plates 109 will be in the position of FIG. 14, and pads 169 will be spaced therefrom, and the front plates 113 and 114 will be in the overlapping positions of FIGS. 12, 14 and 14A to which they have been moved from their positions of FIGS. 9 and 11. Thus, as can be seen from FIG. 14A, the side plates 109 will be raised and will be oriented at an angle to the vertical. At this time the operator slips the open end of a bag 90 (FIG. 13) around the lower outer side portions 170 of chute side plates 109 and draws the bag portion 90' against the rear edges 171 of plates 109 (FIG. 13). As the roller 97 progresses to position C in FIG. 7, and leaves the cam bar 162, the chute plates 109 will return to the position of FIGS. 9, 10 and 11, thereby gripping the bag between pads 169 and the lower portions 170 of chute plates 109. It is to be especially noted, as expressed briefly above, that since the lower portions 170 of chute plates 109 are part of the bag-gripping mechanism, the chute 110 and the bag-gripping mechanism are an integral unit in the sense that the chute 110 must always be in the proper position to conduct produce to a gripped bag. In other words, when a bag is properly gripped, the chute is inherently in the proper produce-conducting position.

The gripper pads 169 are mounted on plates 173 (FIGS. 10 and 13) which are secured to tabs 174 which are pivotally mounted at 175 on links 177 which in turn are pivotally mounted at 178 on laterally extending arms 179 formed integrally with bar 95. A cross link 180 has its opposite ends pivotally connected to links 177 at 181 and 182. The foregoing linkage permits pads 169 to simultaneously move in the same direction when they are spaced from chute side walls 109. Springs 183 extend between the ends 184 of links 177 and the end 185 of a link 187 which is pivotally mounted at 189 on bar 95. The purpose of the foregoing linkage which mounts pads 169 is to permit the pads to move toward and away from the outer sides of chute sides 109 to insure firm gripping of a bag therebetween.

After a bag has been gripped between stations B and C (FIG. 7) in the above-described manner, it proceeds to a station where produce is deposited therein from chute 110 after the produce has been conveyed to chute 110 by conveyor belt 77. After the bag has been filled, and its conveyor trough 35 reaches station A and proceeds toward station B, the sides 109 of chute 110 will move away from pads 169 thereby releasing the upper portion of the bag 90 so that another operator can remove it from the carousel thereby leaving the station from which it was removed free for receiving another bag 90 in the above-described manner.

At this point it is to be noted that most of the above-described bag-gripping and releasing linkage and its associated cam bar 162 is known in the prior art. In this respect, the linkage differs from the prior art in that a roller 97 is used rather than a prior wiper which travels across the cam bar. Furthermore, in the prior art, pads such as 169 were used and they coacted with plates which were mounted on elongated members 104 and essentially were of the shape of the lower portions 170 of chute sides 109. However, the prior art did not have the chute 110 which consists of plates 109, plates 121, rear plate 120', front plates 113 and 114 and plates 125.

Structure is provided for use in conjunction with the carousel bagger for both detecting whether a bag has been mounted on the chute and determining whether a chute is jammed. If a bag is not mounted on the chute, or if a chute is jammed, the machine will stop. The bag detection structure is shown in FIGS. 15–18. In this regard, a frame 192 is attached to a leg 40 of frame 39 by a bracket 193. Frame 192 includes a horizontal base member 194 having an adjustable leg extension 195 thereon for supporting the outer end of member 194 on a floor. A first upstanding post 197 is mounted on member 194 proximate frame leg 40. A second post 199 is mounted on the outer end of member 194. A tube 200 telescopically supports an arm 201 which can be tightened in an adjusted position by set screw mechanism 202. An electric eye 203 is mounted at the outer end of arm 201. A tubular member 204 is mounted on the upper end of post 199, and it telescopically supports an arm 205 which can be retained in position by a set screw mechanism 207. A beam detector switch 209 is mounted on the outer end of arm 205 for detecting the beam from electric eye 203. Beam detector 209 will open if a bag 90 does not pass through the beam within a predetermined period after the previous bag has passed through the beam, depending on the speed of rotation of drive motor 47, thereby breaking the circuit to drive motor 47 and conveyor drive motor 143 to stop the carousel.

A chute jam circuit is also associated with the carousel 37 (FIGS. 2 and 3). In this respect, a post 210 is secured to a leg 40 by a strut 211 and it carries at its upper end an electric eye 212. Electric eye 212 is distance responsive, and it projects its beam downwardly into a chute 110 as it passes thereunder. If the chute is clear, the electric eye will maintain switch 213 closed but if a jam is detected, switch 213 will open to disrupt the flow of current to motors 47 and 143, thereby stopping the carousel until the jam can be cleared.

In operation, assuming that a bag 90 is mounted on chute 110 and assuming chute 110 is not jammed, motors 47 and 143 will drive table 39 and conveyor belts 77. At this time a detection circuit will cause hopper 27 to deposit its load of produce onto conveyor belt 77 when the conveyor trough 35 is beneath hopper 29. In the foregoing respect, an electric eye switch 220 (FIG. 3) is mounted on hopper 29, and a reflector 221 is mounted on a bracket 222 on transparent plate 130 of each conveyor trough 35. When the electric eye switch 220 detects reflector 221, hopper 29 will open to deposit produce onto conveyor belt 77.

Figure 19:
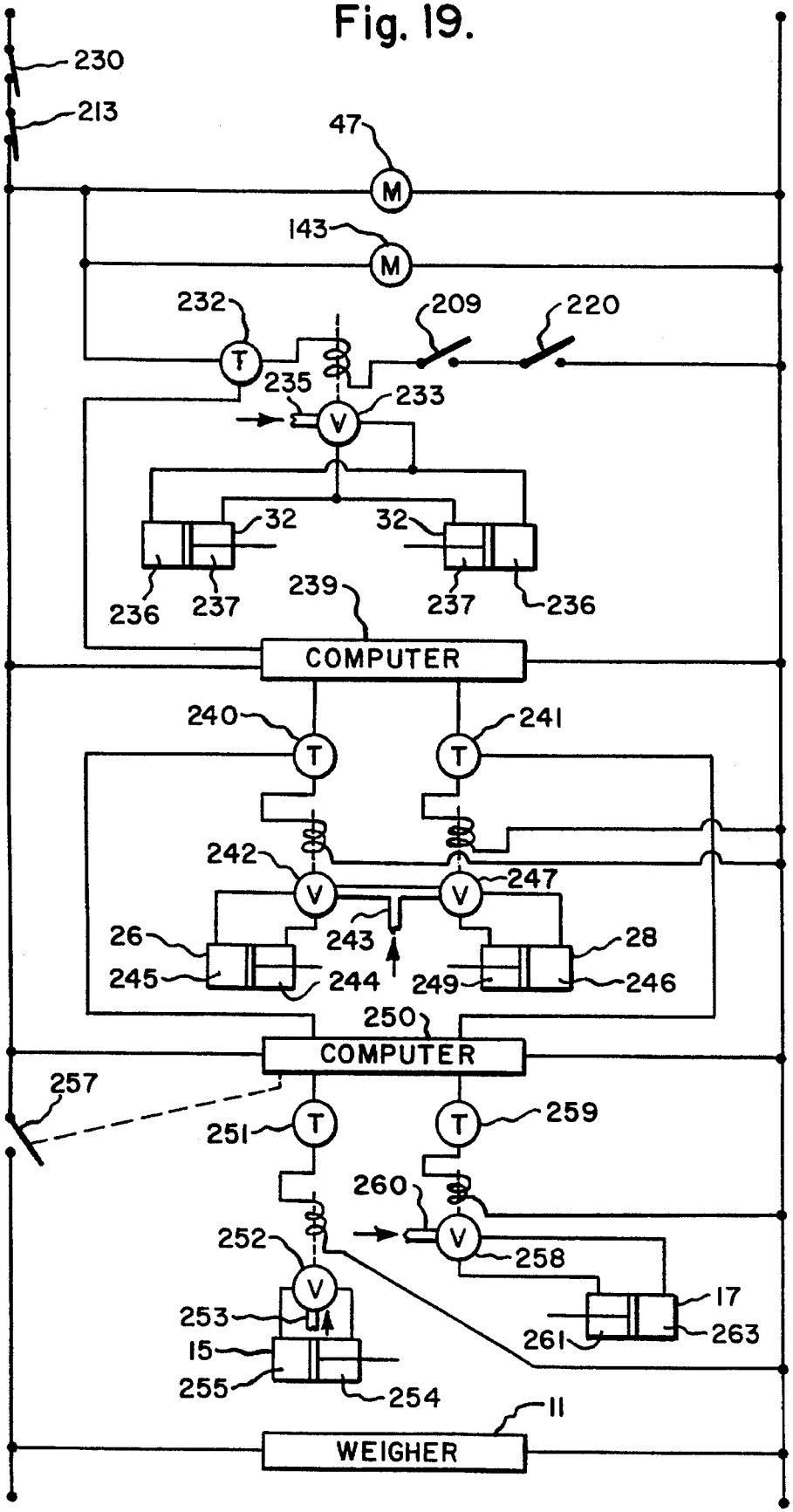
FIG. 19 is a schematic electro-pneumatic diagram of the various controls of the system.

In FIG. 19 a schematic wiring diagram for the system of FIG. 1 is shown. The system includes a main switch 230 which will permit the system to operate when it is closed. Chute clog detector switch 213 is normally closed. However, if it detects a clogged chute, it will open and the system will shut down in its entirety, thereby permitting an operator to unclog the clogged chute. When switch 213 is closed, current will be supplied to rotation motor 47 and belt drive motor 143 so that the carousel will rotate and the conveyor belts will be driven in the above-described manner. Bag detector switch 209 and hopper dump switch 220 are in series with timer 232 and when the normally open switches 209 and 220 are closed, the timer 232 will be actuated and solenoid valve 233 will also be actuated. These switches will close when a bag is detected, as described above, and when the conveyor trough 35 is below the hopper 29. Solenoid actuated valve 233 is a four-way valve having a compressed air inlet 235, and when it is not actuated, it supplies compressed air to chambers 236 of cylinders 32 which cause doors 30 and 31 of hopper 29 to remain closed. However, when valve 233 is actuated in response to the closing of switches 209 and 220, compressed air is supplied to chambers 237 of cylinders 32 to open the doors 30 and 31 to dump the produce into conveyor trough 35 which is then below hopper 29. The timer 232 causes the switches 209 and 220 to remain closed for the predetermined period required for valve 233 to maintain doors 30 and 31 open. After the timer 232 times out, switches 209 and 220 will open to thereby cause valve 233 to return to a position wherein chambers 236 of cylinders 32 are again placed in communication with the compressed air pipe 235 to thereby close the hopper doors 30 and 31.

After the hopper doors 30 and 31 have been closed, hopper 29 is ready to receive its next load of produce from either hopper section 21 or hopper section 22 located above it. As expressed above, hopper sections 21 and 22 open alternately. When timer 232 is actuated in the above-described manner, computer section 239 receives a signal therefrom so as to alternately energize timers 240 and 241. When timer 240 is actuated, solenoid valve 242 is energized so as to supply compressed air from conduit 243 to chamber 244 of cylinder 26 to thereby open door 25 of hopper section 21 which will thus dump produce into hopper 29, and after timer 240 times out, valve 242 will be deactuated so that compressed air will now be supplied to chamber 245 of cylinder 26 to thereby close door 25.

The next time that hopper 29 dumps in response to the closing of bag detector switch 209 and hopper dump switch 220, as described above, computer section 239 will again be actuated in response to timer 232 so that at this time timer 241 will be actuated to actuate solenoid valve 247 which in turn causes compressed air to be supplied to chamber 249 of cylinder 28 thereby opening hopper door 27 of hopper section 22 to thereby dump a load of produce from hopper 22 into hopper 29, and when timer 241 times out valve 247 will be deactuated so that compressed air will be supplied to chamber 246 of cylinder 28 to thereby close hopper door 27.

Hopper sections 21 and 22 are supplied from belt sections 19 and 20, respectively, as described above relative to FIG. 1. Belt sections 19 and 20 are supplied from hopper alternately opening doors 13 and 14, respectively, of hopper 12. Thus, when timer 240 is actuated from computer section 239, computer section 250 will also be actuated to actuate timer 251 which in turn energizes solenoid valve 252 to cause compressed air from conduit 253 to be supplied to chamber 254 of cylinder 15 thereby opening door 13 of hopper 12 to dump produce into conveyor section 19, which conducts the produce to hopper section 21. After the dumping has been effected, the timer 251 will time out and valve 252 will return to a position wherein it supplies compressed air to chamber 255 of cylinder 15 to thereby close hopper door 13. After timer 251 times out and hopper door 13 has been closed, the computer section 250 will close weigher switch 257 to complete a circuit to weigher 11 which will then dump produce into hopper 12 and thereafter computer section 250 will return switch 257 to an open position.

After hopper 29 has been emptied to supply produce to a conveyor trough 35 in the above-described manner, and while hopper section 21 is being filled as described above, hopper section 22 is dumped into hopper 29. In this respect, computer section 239, in response to a signal from timer 232, actuates solenoid valve 247 to supply compressed air to chamber 249 of cylinder 28 to open hopper door 27 to dump produce into hopper 29.

In order to refill hopper section 22, computer section 250 receives a signal from timer 241 to actuate timer 259 to actuate solenoid valve 258 to cause compressed air to be supplied from conduit 260 to chamber 261 of cylinder 17 to thereby open door 14 of hopper 12 to dump produce onto conveyor section 20 which conveys the produce to hopper section 22. After timer 259 times out, computer section 250 will close switch 257 which will cause weigher 11 to dump a load of produce into hopper 12.

From the foregoing description it can be seen that each carousel conveyor trough receives a load of produce from hopper 29 which alternately receives a load of produce from hopper sections 21 or 22 of hopper 23 which in turn receive produce from belt sections 19 and 20, respectively, which in turn alternately receive produce from hopper doors 13 and 14, respectively, of hopper 12 which cyclically receives a load of produce from weigher 11.

As can be seen from the above description, the electric circuit is coupled to the weigher-hopper structure to stop the weigher and all the hoppers when there is a shut-down of the carousel bagger 37.

While the carousel bagger has been mentioned as being used with produce such as potatoes, it will be appreciated that it can be used with citrus fruits and other types of fruits and vegetables which can be bagged in an analogous manner to potatoes.

While preferred embodiments of the present invention have been disclosed, it will be appreciated that the present invention is not limited thereto but may be otherwise embodied within the scope of the following claims.

What is claimed is:

1. A carousel bagger comprising a frame, a vertical shaft rotatably mounted in said frame, a table affixed to said shaft above said frame, a single hopper mounted relative to said frame above said table, a plurality of conveyor troughs having inner and outer ends with said inner ends mounted on said table and said conveyor troughs extending radially outwardly therefrom, each of said conveyor troughs including a trough having an inner trough end and an outer trough end and including a conveyor having an inner conveyor end proximate said inner trough end and an outer conveyor end proximate said outer trough end, a first motor mounted on said frame, a first flexible drive coupled between said first motor and said vertical shaft for rotating said table, a first roller on said conveyor located proximate said inner conveyor end and a second roller located proximate said outer conveyor end and a conveyor belt encircling said first and second rollers, links connecting said second rollers of adjacent conveyors, a second motor mounted on said table for rotating said table to align each of said conveyor troughs sequentially under said hopper, a second flexible drive coupled between said second motor and one of said links for driving said one of said links and all of said second rollers connected thereto, chutes mounted on said outer ends of said troughs, connected front plates and side plates forming the front wall and side walls of said chutes, and bag-gripping means formed integrally with said side plates and located proximate said lower portions of said chutes.

2. A carousel bagger as set forth in claim 1 wherein said side plates comprise first and second side plates, and wherein said front plates comprise first and second front plates, and each of said chutes comprises a rear plate located underneath said outer end of said conveyor, said bag-gripping means also including first and second pads located outwardly of lower portions of said first and second side plates, respectively, and linkage means coupled to said first and second side plates for selectively causing said first and second side plates and said first and second front plates to move toward each other and away from said first and second pads, respectively, to assume a position wherein the open end of a bag may be mounted in encircling relationship to said first and second lower portions of said first and second side plates.

3. A carousel bagger as set forth in claim 2 including first and second stationary side plates mounted on said trough proximate said first and second side plates, respectively, on the opposite sides thereof from said first and second front plates, respectively.

4. A carousel bagger as set forth in claim 2 wherein said first and second front plates are offset frontally from each other so that they can assume an overlapping relationship when said first and second side plates are moved toward each other.

5. A carousel bagger as set forth in claim 4 wherein said frame includes a plurality of frame sides, and a plurality of third rollers mounted on horizontal shafts extending outwardly from said frame sides for supporting said table for rotation.

6. A carousel bagger as set forth in claim 2 including a cam bar mounted on said frame, and means on said linkage means for engaging said cam bar for causing said first and second side plates and said first and second front plates to move toward each other and away from said first and second pads, respectively.

7. A carousel bagger as set forth in claim 2 wherein said trough includes trough side walls on the opposite sides of said conveyor belt and extending lengthwise thereof substantially between said inner end of said conveyor and said first and second front plates of said chute, and a stationary front wall on said trough located between said trough side walls above said first and second front plates of said chute.

8. A carousel bagger as set forth in claim 7 including a stationary rear wall on said trough located between said trough side walls at said inner end of said trough.

9. A carousel bagger as set forth in claim 1 including means for moving said first and second rollers toward and away from each other.

10. A carousel bagger as set forth in claim 1 including chute detection means mounted relative to said chutes for detecting whether said chutes are clogged.

11. A carousel bagger as set forth in claim 10 including bag detection means mounted relative to said chutes for detecting whether a bag is mounted on said bag-gripping means.

12. A carousel bagger as set forth in claim 1 including means for opening said hopper for depositing produce into a conveyor trough when said conveyor trough passes underneath said hopper.

13. A carousel bagger as set forth in claim 12 including chute detection means mounted relative to said chutes for detecting whether said chutes are clogged.

14. A carousel bagger as set forth in claim 12 including bag detection means mounted relative to said chutes for detecting whether a bag is mounted on said bag-gripping means and for preventing depositing of produce from said produce-storing hopper into said conveyor trough when a bag is not gripped by said bag-gripping means.

15. A carousel bagger comprising a frame, a single hopper mounted relative to said frame, a table rotatably mounted on said frame, a plurality of conveyor troughs mounted on said table, means for rotating said table to align each of said conveyor troughs sequentially under said hopper, each of said conveyor troughs including a trough and a conveyor, a bag-gripping mechanism mounted on each of said troughs, chutes mounted on each of said troughs between said conveyors and said bag-gripping mechanism, and chute-clogging detection means mounted relative to said chutes for detecting clogging of said chutes.

16. A carousel bagger as set forth in claim 15 including bag-detecting means for detecting whether a bag is being gripped by said bag-gripping mechanism.

17. A carousel bagger as set forth in claim 16 in combination with a hopper for depositing produce into said troughs, and means responsive to detecting the absence of a bag held by said bag-gripping mechanism for preventing the deposit of produce from said hopper into a trough associated with said absent bag.

* * * * *